US011441455B2

(12) United States Patent
Lee et al.

(10) Patent No.: US 11,441,455 B2
(45) Date of Patent: Sep. 13, 2022

(54) METHOD OF CONTROLLING OIL PUMP OF VEHICLE

(71) Applicants: HYUNDAI MOTOR COMPANY, Seoul (KR); KIA MOTORS CORPORATION, Seoul (KR)

(72) Inventors: Min Yong Lee, Incheon (KR); Seong Sik Kim, Bucheon-si (KR); Jun Sik Park, Seoul (KR); Hyun Kyu Lim, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 116 days.

(21) Appl. No.: 16/993,579

(22) Filed: Aug. 14, 2020

(65) Prior Publication Data

US 2021/0079819 A1 Mar. 18, 2021

(30) Foreign Application Priority Data

Sep. 16, 2019 (KR) ..... 10-2019-0113555

(51) Int. Cl.

*F01M 1/16* (2006.01)
*F01M 1/02* (2006.01)
*F01M 1/20* (2006.01)

(52) U.S. Cl.

CPC ..... *F01M 1/16* (2013.01); *F01M 1/02* (2013.01); *F01M 1/20* (2013.01); *F01M 2250/60* (2013.01); *F01M 2250/64* (2013.01)

(58) Field of Classification Search

CPC .. F01M 1/16; F01M 1/02; F01M 1/20; F01M 2250/60; F01M 2250/64; F01M 2011/1446

See application file for complete search history.

(56) References Cited

U.S. PATENT DOCUMENTS

2013/0192557 A1* 8/2013 Rollinger ..... F01M 1/16 123/196 R
2015/0377115 A1* 12/2015 Shinagawa ..... F02D 37/02 123/41.15
2021/0071551 A1* 3/2021 Ni ..... F01M 1/02

* cited by examiner

*Primary Examiner* — Jacob M Amick
(74) *Attorney, Agent, or Firm* — Lempia Summerfield Katz LLC

(57) ABSTRACT

A method of controlling an oil pump of a vehicle includes: acquiring, by a controller, information on an engine operating state or a driving condition detected by a driving information detection part; determining, by the controller, whether a predetermined condition of an alternate mode is satisfied on the basis of the acquired information on the engine operating state or the driving condition; and, when the condition of the alternate mode is satisfied, sequentially performing, by the controller, a high-pressure operation control that controls an operation of an oil pump system so as to an oil pressure of an engine to converge on a predetermined target high-pressure value and a low-pressure operation control that controls the oil pressure of the engine to converge on a predetermined target low-pressure value.

12 Claims, 5 Drawing Sheets

METHOD OF CONTROLLING OIL PUMP OF VEHICLE

CROSS-REFERENCE TO RELATED APPLICATION

This application claims priority to and the benefit of Korean Patent Application No. 10-2019-0113555, filed on Sep. 16, 2019, the entire contents of which are incorporated herein by reference.

FIELD

The present disclosure relates to a method of controlling an oil pump of a vehicle.

BACKGROUND

The statements in this section merely provide background information related to the present disclosure and may not constitute prior art.

An engine includes many parts including moving part, and, during operation of the engine, the moving parts contact with each other.

When the moving parts move while being in contact with each other in the engine, heat is generated due to friction, and a cooling fluid such as cooling water or oil is used to prevent damage to the parts due to frictional heat.

The oil also acts as lubrication to reduce friction between the engine parts. As an oil pump operates, the oil is transferred to each of the parts of the engine.

For example, in order to supply the oil for lubrication on a moving part such as a piston or a crankshaft of the engine, an oil supply device including an oil pump is provided.

In this case, the oil is supplied to an oil gallery provided on one side of a cylinder block and then supplied to a cooling jet connected to the oil gallery. The cooling jet is installed to inject the oil to the piston.

The conventional oil pump is connected to the crankshaft such that a discharge flow rate can be adjusted in proportion to an engine revolution per minute (RPM). Thus, the discharge flow rate also increases in proportion to the engine RPM.

However, since the conventional oil pump discharges and supplies the oil in proportion to the engine RPM regardless of a lubrication state, the conventional oil pump has a problem of degrading fuel efficiency of the engine.

Accordingly, a variable capacity oil pump system has been developed and used to improve fuel efficiency by controlling a valve to apply only an oil pressure desired at a corresponding engine RPM by an oil pump.

In particular, a continuously variable capacity oil pump system for improving fuel efficiency has been developed to variously control an oil pressure according to an engine operating condition.

For example, in order to improve or maximize an effect of fuel efficiency improvement, control is performed with a relatively low oil pressure in a low RPM region and performed with a relatively high oil pressure in a high RPM region.

However, we have discovered that the continuously variable capacity oil pump system also has the following problems.

First, owing to low oil pressure control so as to achieve an effect of fuel efficiency improvement, the cooling jet operation is not possible such that there occurs a disadvantage in terms of lubrication of a piston scuff.

Further, when the control is performed with the high oil pressure in consideration of durability of the engine, it is difficult to achieve a target fuel efficiency, and there may occur a problem of poor performance with respect to an exhaust gas in a particulate number (PN) and the like due to a drop in piston temperature according to an operation of the cooling jet.

When oil is injected through a piston cooling jet in all operating areas including excessive fuel quantity such as a cold starting of an engine, a reduction condition of a gap between metal parts, and a general operating condition, durability of the piston scuff and the like can be secured, whereas, when the piston cooling jet is operated in a cold condition, discharge performance of the exhaust gas such as PN and the like may be degraded.

The above information disclosed in this Background section is only for enhancement of understanding of the background of the present disclosure and therefore it may contain information that does not form the prior art that is already known to a person of ordinary skill in the art.

SUMMARY

In one aspect, the present disclosure provides an improved method of controlling an oil pump, which is capable of solving both a problem of poor lubrication of engine parts during low oil pressure control and a problem of degradation in fuel efficiency and poor exhaust gas emission during high oil pressure control.

In one form, a method of controlling an oil pump of a vehicle includes: acquiring, by a controller, information on an engine operating state or a driving condition detected by a driving information detection part; selecting, by the controller, a control mode satisfying a predetermined condition on the basis of the acquired information on the engine operating state or the driving condition among a plurality of control modes for controlling an operation of an oil pump system; and controlling, by the controller, the operation of the oil pump system to control an oil pressure of an engine to a target value corresponding to the selected control mode among the plurality of control modes.

Here, the plurality of control modes may include an alternate mode, and, when a predetermined condition of the alternate mode is satisfied, the alternate mode is selected; and in controlling the oil pump system, sequentially performing, by the controller, a high-pressure operation control that controls the operation of the oil pump system so as to allow the oil pressure of the engine to converge on a predetermined target high-pressure value, and a low pressure operation control that controls the operation of the oil pump system so as to allow the oil pressure of the engine to converge on a predetermined target low-pressure value.

In some forms of the present disclosure, the plurality of control modes may also include a high-pressure mode, and, when a predetermined condition of the high-pressure mode during starting the engine, the high-pressure mode is selected. In controlling the operation of the oil pump system, the controller may perform the high-pressure mode control during starting that controls the operation of the oil pump system so as to allow the oil pressure of the engine to converge on a predetermined target high-pressure value.

In some forms of the present disclosure, the driving information detection part may include a temperature sensor configured to detect an oil temperature which is a temperature of engine oil or a water temperature which is a temperature of cooling water of the engine, and an engine revolutions per minute (RPM) sensor for detecting an engine RPM, and, after an engine starting request is detected, when the engine RPM detected by the engine RPM sensor reaches a set RPM and an oil temperature or a water temperature detected by the temperature sensor is less than or equal to a predetermined low critical temperature, the controller may be set to determine that the predetermined condition of the high-pressure mode is satisfied.

In some forms of the present disclosure, when the oil temperature or the water temperature detected by the temperature sensor exceeds the predetermined low critical temperature and is less than a predetermined high critical temperature, the controller may be set to determine that the condition of the alternate mode is satisfied.

In some forms of the present disclosure, the high-pressure mode control during starting the engine may include: determining a high-pressure maintaining time according to a current oil temperature or a current water temperature using setting information stored in the controller, performing high-pressure operation control that counts the high-pressure maintaining time after an high-pressure operation is turned on and controls the operation of the oil pump system so as to allow the oil pressure of the engine to converge on the predetermined target high-pressure value while the high-pressure maintaining time is counted, and, when a high-pressure maintaining time, during which the operation of the oil pump system is controlled, reaches the determined high-pressure maintaining time, terminating the high-pressure operation control.

The driving information detection part may include a temperature sensor configured to detect an oil temperature which is a temperature of engine oil or a water temperature which is a temperature of cooling water of the engine, and, when the oil temperature or the water temperature detected by the temperature sensor falls within a predetermined temperature range, the controller may be set to determine that the condition of the alternate mode is satisfied.

In some forms of the present disclosure, the alternate mode control may include determining a high-pressure maintaining time according to a current oil temperature or a current water temperature using setting information stored in the controller, performing high-pressure operation control that counts the high-pressure maintaining time after an high-pressure operation is turned on and controls the operation of the oil pump system so as to allow the oil pressure of the engine to converge on the predetermined target high-pressure value while the high-pressure maintaining time is counted, and, when a high-pressure maintaining time, during which the operation of the oil pump system is controlled, reaches the determined high-pressure maintaining time, terminating the high-pressure operation control and checking the current oil temperature or the current water temperature again, determining a low-pressure maintaining time according to the current oil temperature or the current water temperature, which is checked again, using setting information stored in the controller, performing low-pressure operation control that counts the low-pressure maintaining time after a low-pressure operation is turned on and controls the operation of the oil pump system so as to allow the oil pressure of the engine to converge on the predetermined target low-pressure value while the low-pressure maintaining time is counted, and, when the low-pressure maintaining time, during which the operation of the oil pump system is controlled, reaches the determined low-pressure maintaining time, terminating the low-pressure operation control, and, when a predetermined alternate mode condition is satisfied until an engine off request is detected, repeating the alternate mode control.

In some forms of the present disclosure, the method may further include, after the determining of the high-pressure maintaining time, checking whether the high-pressure maintaining time is zero second, and, when the high-pressure maintaining time is not zero second, repeating the alternate mode control.

In some forms of the present disclosure, when the high-pressure maintaining time is zero second, the controller may be set to turn the low-pressure operation on to count the low-pressure maintaining time and control the operation of the oil pump system so as to allow the oil pressure of the engine to converge on the predetermined target low-pressure value while the low-pressure maintaining time is counted.

In some forms of the present disclosure, when the oil temperature or the water temperature, which is detected by the temperature sensor, is greater than or equal to the high critical temperature, the controller may set to perform high-temperature and high-pressure mode control that controls the operation of the oil pump system so as to allow the oil pressure of the engine to converge on a predetermined target high-pressure value.

In some forms of the present disclosure, the driving information detection part may include an accelerator pedal position sensor configured to detect an accelerator pedal manipulation state by a driver, the plurality of control modes include a high-pressure mode, and, in the selecting of the control mode, when a predetermined rapid acceleration condition is determined as being satisfied from a signal of the accelerator pedal position sensor, the controller may select the high-pressure mode and, when the high-pressure mode is selected, in the controlling of the operation of the oil pump system, the controller may be set to perform the high-pressure mode control that controls the operation of the oil pump system so as to allow the oil pressure of the engine to converge on a predetermined target high-pressure value.

In some forms of the present disclosure, the plurality of control modes may include the high-pressure mode, and, in the selecting of the control mode, when the controller determines a knocking generation condition of the engine from the engine operating condition or operating condition, the controller may select the high-pressure mode and, when the high-pressure mode is selected, in the controlling of the operation of the oil pump system, the controller may be set to perform the high-pressure mode control that controls the operation of the oil pump system so as to allow the oil pressure of the engine to reach a predetermined target high-pressure value.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
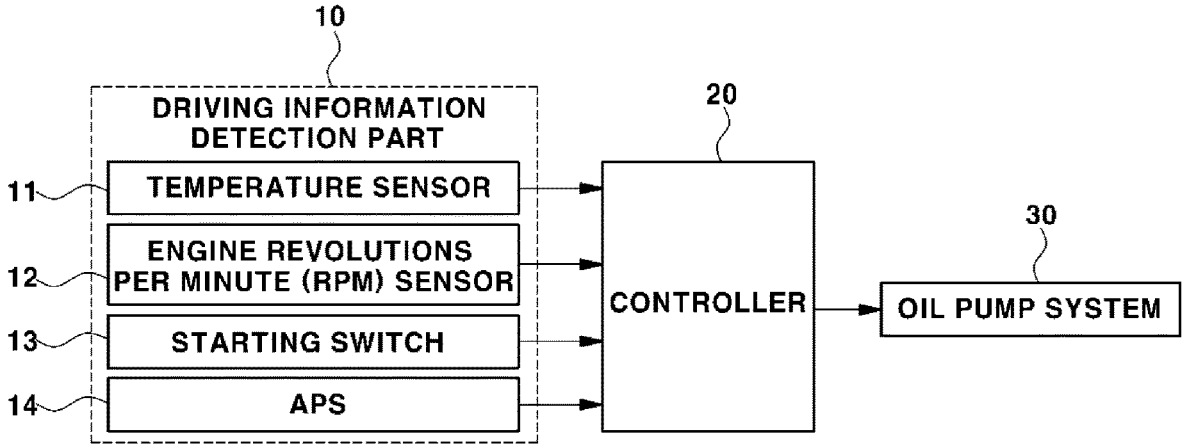
FIG. 1 is a block diagram of a device for performing an oil pump control process of a vehicle in one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, exemplary forms of the present disclosure will be fully described in a detail which is suitable for implementation by those skilled in the art to which the present disclosure pertains with reference to the accompanying drawings.

It should be understood that the appended drawings are not necessarily to scale, presenting a somewhat simplified representation of various features illustrative of the basic principles of the present disclosure. The specific design features of the present disclosure as disclosed herein, including, for example, specific dimensions, orientations, locations, and shapes will be determined in part by the particular intended application and use environment.

Throughout this disclosure, when an element is referred to as "comprising" a component, it refers that the element can further include other components, not excluding the other components unless specifically stated otherwise.

The present disclosure relates to a method of controlling an oil pump of a vehicle so as to supply oil for cooling and lubrication of parts to an engine. More particularly, it relates to an improved method of controlling a continuously variable capacity oil pump so as to solve both a problem of poor lubrication of the parts during low oil pressure control and a problem of degradation in fuel efficiency and poor exhaust gas emission during high oil pressure control.

In the present disclosure, in order to complement the problem in that advantages and disadvantages coexist in an oil pump control method according to the related art, temporarily high pressure control (which is high pressure mode control during starting, which will be described below) during starting and alternate control of a low-pressure and a high-pressure (which is alternate mode control which will be described below) are selectively performed according to an oil temperature, a water temperature, an engine operating state, or an operating condition.

Here, the oil temperature means a temperature of an engine oil for lubrication and cooling of the parts of the engine, and the water temperature means a temperature of cooling water of the engine, which indicates an engine temperature. These meanings are also applied to the following description.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

When there is a disadvantage in a cold starting in terms of lubrication and oil injection and there is a condition in which oil injection through a cooling jet is desired for durability of the parts such as pistons and the like of the engine, the high pressure mode control may be performed during starting for a period of time which is determined according to an oil temperature or a water temperature during starting and may return to low pressure control after high pressure control.

When the engine operating state or the operating condition satisfies a predetermined condition during starting, the high pressure mode control during starting is performed and includes a process of performing control to maintain the oil pressure at a target high-pressure value in a predetermined high-pressure state for a maintaining time which is determined according to a current oil temperature or a current water temperature.

Here, the maintaining time may be set to a time within a limit not affecting discharge performance according to an oil temperature condition or a water temperature condition, and a target pressure value in the high-pressure mode control during starting may be set to a pressure that is higher than an opening pressure of the piston cooling jet, i.e., a high-pressure at which oil is injectable through the piston cooling jet.

Thus, when the high-pressure mode control is performed during starting, durability of the parts of the engine may be improved without adversely affecting performance of the exhaust gas emission.

In one form of the present disclosure, even during starting, a range of the oil temperature or the water temperature, in which the high-pressure mode control is not performed, may be set and this does not mean that the high-pressure mode control is unconditionally performed whenever a starting is performed.

That is, in the case of a vehicle with an idle stop and go (ISG) system, an engine is turned off in a stop state such as waiting for a signal and then is restarted when the vehicle starts. In this case, during the restarting of the engine, since oil is sufficiently supplied to fill in parts of the engine, oil injection through a cooling jet is not necessary.

Further, during the above-described restarting of the engine, since the oil temperature or the water temperature is exhibited to be higher than a predetermined level, the high-pressure mode control during starting may be directed not to be performed within a predetermined range of the oil temperature or the water temperature during a usual restarting of the engine according to an operation of the ISG.

Further, in the present disclosure, when the oil temperature or the water temperature is within a set range, a low-pressure operation, in which improvement of fuel efficiency is possible, for a predetermined period of time and a high-pressure operation, in which injection of the piston cooling jet is possible, for a predetermined period of time are alternately performed such that fuel efficiency may be improved and durability of the piston scuff and the like may be secured.

Further, as described below, in an alternate mode in which the low-pressure operation and the high-pressure operation are controlled to be performed alternately, the oil temperature or the water temperature may be set in a range in which a high-pressure maintaining time is zero second.

In the alternate mode, when the high-pressure maintaining time is zero second according to the oil temperature or the water temperature, only the low-pressure operation is controlled to be performed without performing the high-pressure operation.

Further, when a warm-up of engine oil is slow due to cold weather and a low outside temperature in winter, since it is inevitable to expose to an engine cold condition for a long period of time not only during starting but also even in an engine idle state (a stop and creep driving), in the present disclosure, the alternate control of the low-pressure and the high-pressure is performed according to whether to reach a set temperature range.

In the present disclosure, the low-pressure operation and the low-pressure control mean to operate and control an oil pump system so as to maintain a low oil pressure state of a predetermined level, and the high-pressure operation and the high-pressure control mean to operate and control the oil pump system so as to maintain a high oil pressure state of a predetermined level.

In particular, the high-pressure operation and the high-pressure control are to control the oil pressure to be higher than the opening pressure of the cooling jet. When the oil temperature or the water temperature is within the set temperature range, the low-pressure operation and the high-pressure operation for injection of the cooling jet for a predetermined period of time are controlled to be performed alternately such that improvement of fuel efficiency and durability improvement of the parts of the engine are simultaneously achieved.

In addition to the above description, when the oil temperature or the water temperature becomes in a high-temperature state of which temperature is higher than the temperature range in which the low-pressure operation and the high-pressure operation are alternately performed, the high-pressure operation may be performed.

In addition, according to this present disclosure, a method for controlling an oil pump can perform better without a separate valve device to control the cooling jet than the prior art.

FIG. 1 is a block diagram of a device for performing an oil pump control process of a vehicle according to one form of the present disclosure. As shown in the drawing, the device for performing an oil pump control process includes a driving information detection part 10, a controller 20, and an oil pump system 30.

In one form, the oil pump system 30 may be a continuously variable capacity oil pump system, and an oil pump system may be applied as the oil pump system 30 as long as the oil pump system can control an oil pressure according to predetermined target values including a high pressure and a low pressure.

In the following description, the oil pressure may mean a pressure of oil supplied to the engine by the oil pump system 30, and more specifically, a pressure of oil supplied to the piston cooling jet of the engine.

The driving information detection part 10 is a configuration part for detecting real-time information on an engine operating state or an operating condition. The real-time information on the engine operating state or the operating condition may include oil temperature or water temperature (a temperature of cooling water) information, engine starting and off information, and engine revolutions per minute (RPM) information.

In this case, the driving information detection part 10 may include a temperature sensor 11 for detecting an oil temperature or a temperature sensor for detecting a water temperature, and an engine RPM sensor 12 for detecting an engine RPM.

In addition, the driving information detection part 10 may further include a starting switch 13 for outputting a signal according to an engine starting and an engine off.

Here, the temperature sensor 11 for detecting an oil temperature, the temperature sensor for detecting a water temperature, and the engine RPM sensor 12 for detecting the engine RPM are known sensors which are mounted and used in a vehicle. Further, the starting switch 13 is a known configuration which is already mounted in the vehicle.

The engine RPM sensor 12 may be a sensor installed on a camshaft or a sensor installed on a crankshaft.

The controller 20 detects an engine starting request and an engine off request in the vehicle, and, when the engine is started to be in an engine on state according to the engine starting request, the controller 20 acquires current oil temperature or water temperature information from a signal of the temperature sensor 11 and acquires current engine RPM information from a signal of the engine RPM sensor 12.

Here, the engine starting includes both an engine starting which is performed such that a driver turns the starting switch 13 on and an engine starting which is performed such that a known condition is satisfied in an engine off state.

Further, target pressure values for controlling a low-pressure operation and a high-pressure operation, i.e., a target low-pressure value and a target high-pressure value are preset in the controller 20.

In addition to the above description, a low-pressure maintaining time for maintaining a low-pressure operation and a high-pressure maintaining time for maintaining a high-pressure operation are preset in the controller 20 as time values according to an oil temperature or a water temperature.

That is, setting information, in which the low-pressure maintaining time for maintaining a low-pressure operation and the high-pressure maintaining time for maintaining a high-pressure operation are set as time values according to an oil temperature or a water temperature, is input and stored in the controller 20 in advance and used.

Thus, the controller 20 may determine the low-pressure maintaining time and the high-pressure maintaining time corresponding to a current oil temperature or a current water temperature from the setting information. In this case, the setting information may be a map, a table, a graph, or the like in which the low-pressure maintaining time and the high-pressure maintaining time are set according to the oil temperature or the water temperature.

The setting information may be acquired or tuned using data obtained in a previous evaluation and a test process for vehicles having the same specifications and input and stored in the controller 20 in advance to be used to determine pressure maintaining times, i.e., the high-pressure maintaining time and the low-pressure maintaining time.

Figure 2:
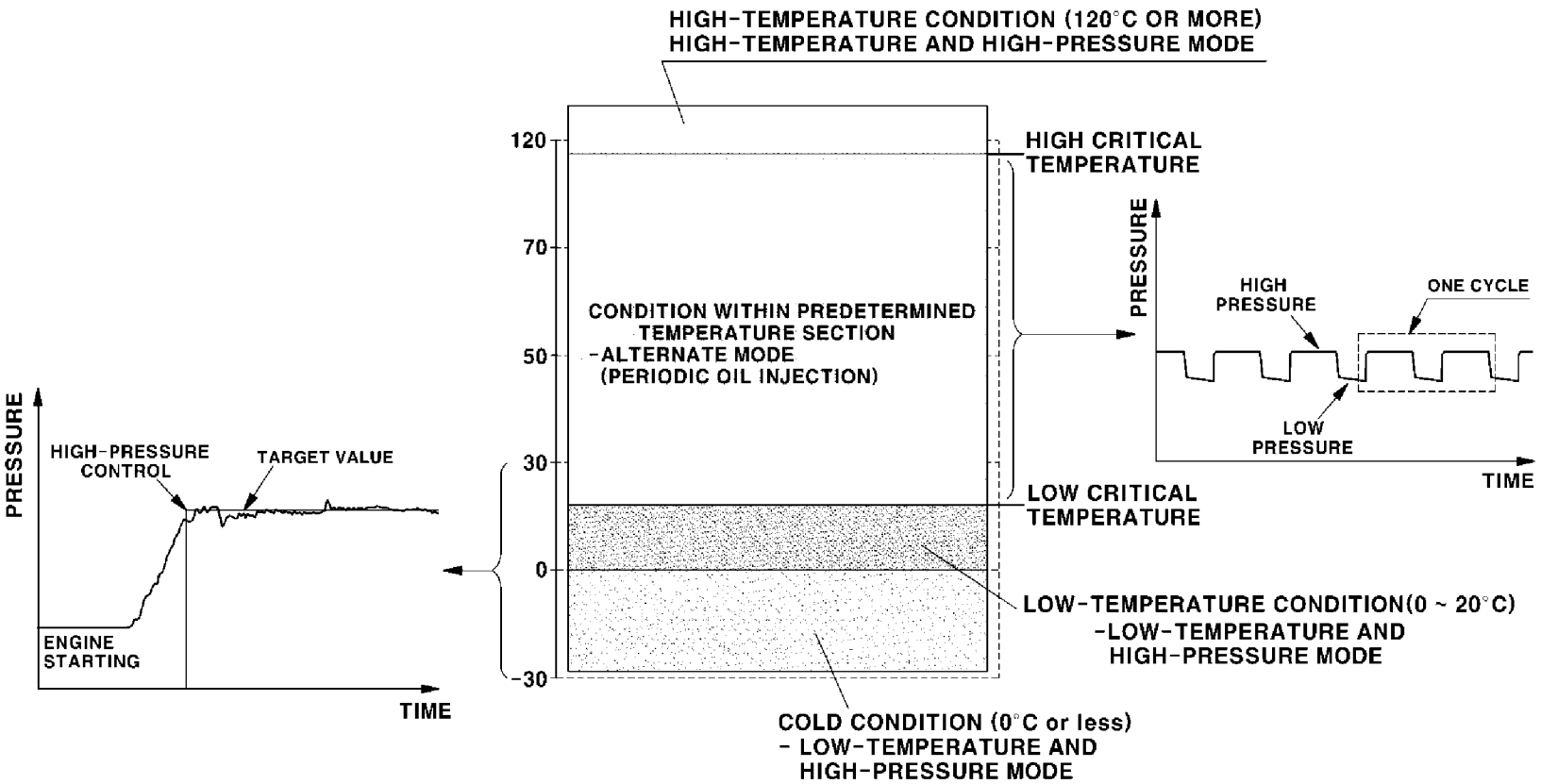
FIG. 2 is a schematic diagram illustrating an oil pressure control state according to an engine operating state or an operating condition in one form of the present disclosure.

FIG. 2 is a schematic diagram illustrating an oil pressure control state according to an engine operating state or an operating condition. When the oil temperature (or the water temperature) is less than or equal to a critical temperature (e.g., 20° C.) after the engine starting or in the engine idle state (a stop, during creep driving, and the like), a state of a high-pressure mode during starting, in which high-pressure operation control is performed for a predetermined period of time, is illustrated in a left side of FIG. 2.

Further, a state of the alternate mode, in which the high-pressure operation control and low-pressure operation control are alternately performed for a predetermined period of time in a set temperature range, i.e., a temperature range exceeding a low critical temperature and less than a high critical temperature, is illustrated in a right side of FIG. 2.

Further, target pressure values during the high-pressure operation and a target pressure value during the low-pressure operation are preset in the controller 20, and the controller 20 controls oil pressures during the high-pressure operation and the low-pressure operation to be the set target pressure values.

That is, a target high-pressure value in the high-pressure mode during starting, a target high-pressure value for the high-pressure operation in the alternate mode, and a target low-pressure value for the low-pressure operation are preset in the controller 20. The target high-pressure value in the high-pressure mode during starting and the target high-pressure value in the alternate mode may be set to the same value or different values.

In the present disclosure, the high-pressure control in each of the high-pressure mode and the alternate mode during starting and the low-pressure control in the alternate mode are performed for predetermined maintaining times. Here, as described above, the predetermined maintaining times are determined to correspond to the current oil temperature or the current water temperature.

Further, the high-pressure maintaining times according to the oil temperature or the water temperature may be differently set by discriminating the high-pressure mode during starting from the alternate mode even in the same oil temperature or the same water temperature. In other form, when the oil temperature or the water temperature is equal in the high-pressure mode and the alternate mode, the high-pressure maintaining times may be set to be the same as each other.

Further, an oil pressure control mode, which is discriminately set according to the oil temperature, is illustrated in a center of FIG. 2.

As illustrated in the center of FIG. 2, during starting or in an engine idle state, the high-pressure mode during starting is selected by the controller 20 in a low-temperature condition in which the oil temperature is less than or equal to the low critical temperature, i.e., in a cold condition less than 0° C. and in a low-temperature condition ranging from 0° C. to 20° C.

Further, in the temperature range exceeding the low critical temperature and less than the high critical temperature, the alternate mode in which the high-pressure operation and the low-pressure operation are alternately performed for a predetermined period of time is selected, and thus oil may be injected to the piston through the cooling jet only during the high-pressure operation for a predetermined period of time. Thus, in the alternate mode, periodic oil injection of the cooling jet is performed in a period of the low-pressure maintaining time.

Further, as in the condition in which the oil temperature is less than or equal to the low critical temperature, in a condition in which the oil temperature (or the water temperature) is greater than or equal to the high critical temperature, a high-temperature and high-pressure mode for controlling the oil pressure to be a set target high-pressure value is performed.

A high-pressure maintaining time in the high-temperature and high-pressure mode may also be determined as a time corresponding to the current oil or water temperature in the controller 20. To this end, even with respect to the high-temperature and high-pressure mode, setting information in which a maintaining holding time is set according to the oil temperature or the water temperature may be input and stored in the controller 20 in advance and used.

Meanwhile, the following Tables 1 and 2 illustrate the setting information in the form of a table in which high-pressure maintaining times and low-pressure maintaining times are set in the high-pressure mode during starting and the alternate mode.

TABLE 1

| Targethigh-pressurevalue: $P_{H_target_1}$ | | | | | | | |
|---|---|---|---|---|---|---|---|
| | | Oil temperature or Water temperature | | | | | |
| High Pressure | T(° C.) | First Section | Second Section | Third Section | Fourth Section | Fifth Section | . . . |
| | X(sec) | t11 | t12 | t13 | t14 | t15 | |

t11~t15: zero sec, or 1 sec or more

TABLE 2

| Target high-pressure value: $P_{H_target_1}$, Target low-pressure value: $P_{L_target}$ | | | | | | | |
|---|---|---|---|---|---|---|---|
| | | Oil temperature or Water temperature | | | | | |
| High Pressure | T(° C.) | Sixth Section | Seventh Section | Eight Section | Ninth Section | Tenth Section | . . . |
| | Y(sec) | t1 | t2 | t3 | t4 | t5 | |
| Low Pressure | T(° C.) | Sixth Section | Seventh Section | Eight Section | Ninth Section | Tenth Section | |
| | Z(sec) | t6 | t7 | t8 | t9 | t10 | |

t1~t10: zero sec, or 1 sec, or more

Table 1 shows the high-pressure maintaining times which are set for each temperature section in the high-pressure mode during starting, and Table 2 shows the high-pressure maintaining times and the low-pressure maintaining times, which are set for each temperature section in the alternate mode.

In Table 1 and Table 2, temperature sections (first to tenth sections) of the oil temperature or the water temperature may be determined in the form of a temperature range. During control of each mode, when the current oil temperature or the current water temperature falls within a temperature range of a specific temperature section, a time (sec.) of X, Y, or Z corresponding to the specific temperature section is determined as a maintaining time for maintaining the high-pressure operation or the low-pressure operation in a corresponding mode.

Further, in Tables 1 and 2, among all the temperature sections (first to tenth sections) of the oil temperature or the water temperature, temperature sections with the same maintaining time may be present.

Further, even though temperature ranges between two modes (the high-pressure mode during starting and the alternate mode) of Tables 1 and 2 are the same as each other, and even though the temperature ranges between the two modes at least partially overlap, when the two modes are different from each other, maintaining times may be set differently. In some cases, the same maintaining time may be set.

A target high-pressure value $P_{H_target1}$ in the high-pressure mode during starting and a target high-pressure value $P_{H_target2}$ in the alternate mode may be the same as or different from each other, and a temperature section with a maintaining time of 0 sec. may be present in the alternate mode.

In Tables 1 and 2, "$P_{L_target}$" indicates a target low-pressure value in the alternate mode.

As described above, in the present disclosure, a mode is selected and determined on the basis of the engine operating state or driving condition information. Further, a high-pressure maintaining time or a low-pressure maintaining time of a mode which is selected according to the current oil temperature or water temperature state is determined using the setting information as shown in Tables 1 and 2.

Hereinafter, an oil pump control process according to the present disclosure will be described in more detail with reference to the accompanying drawings.

Figure 3:
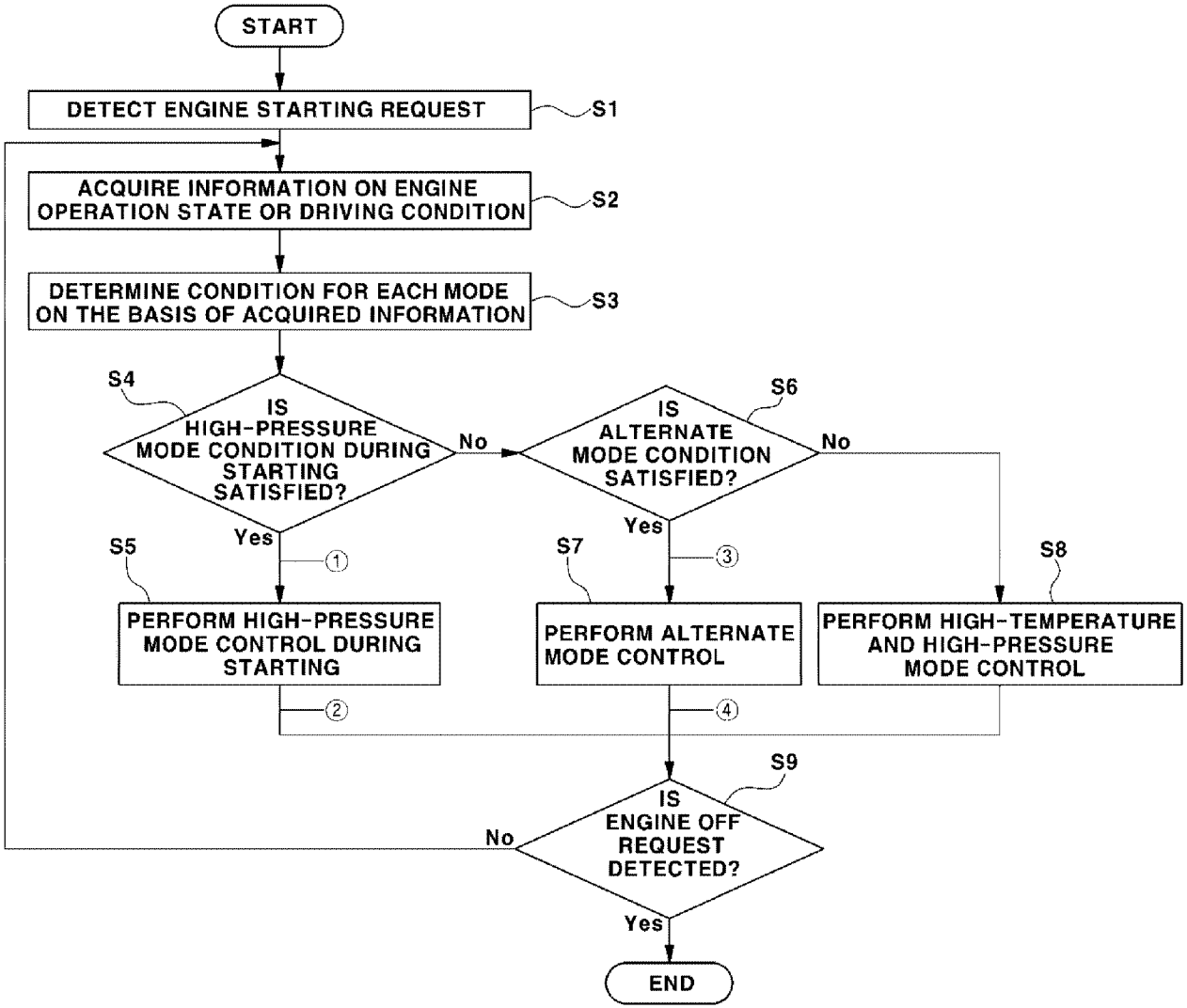
FIG. 3 is a flowchart illustrating an oil pump control process according to one form of the present disclosure.

First, to describe the drawings, FIG. 3 is a flowchart illustrating an entirety of an oil pump control process according to the present disclosure.

Figure 4:
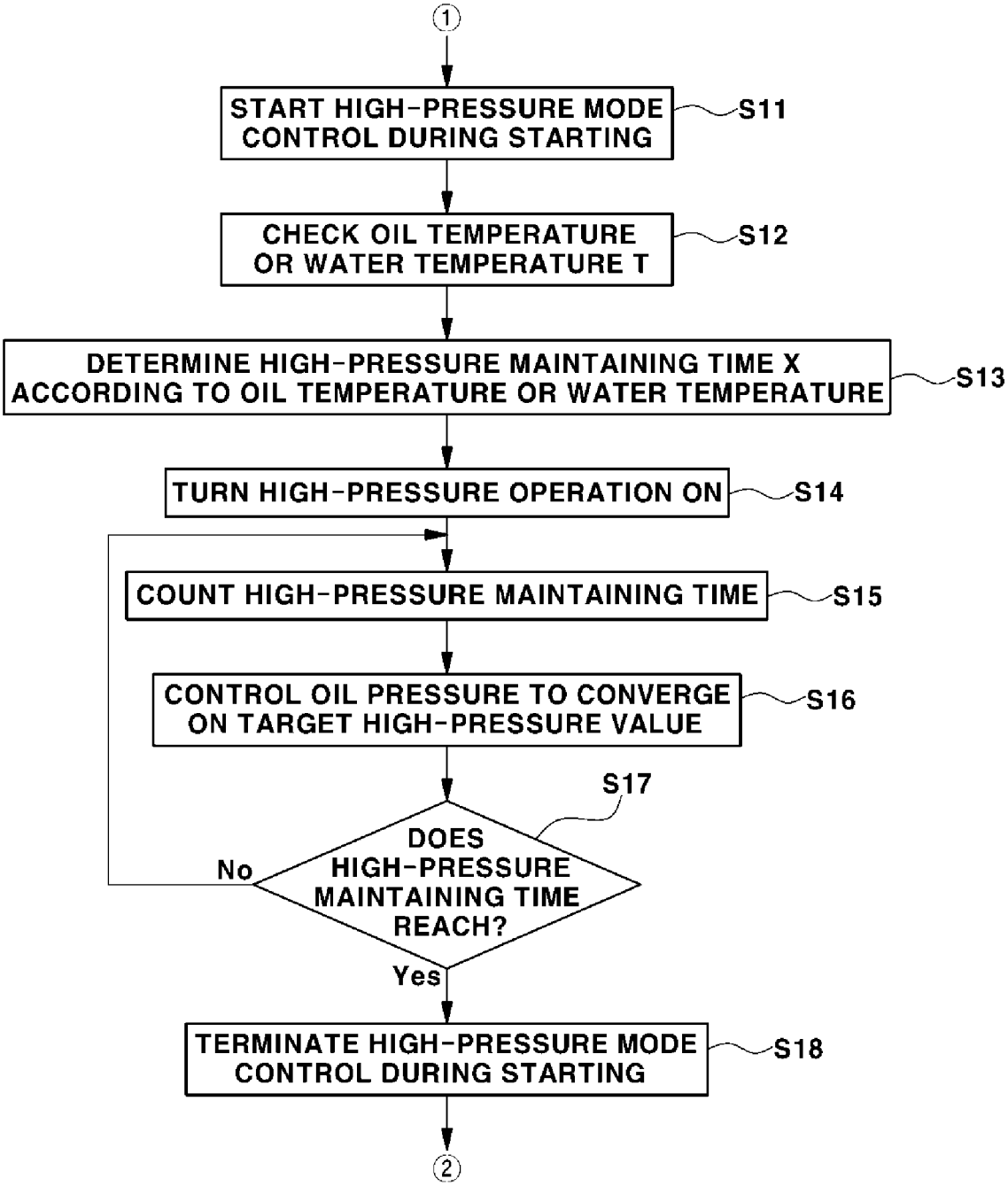
FIG. 4 is a flowchart illustrating a process in which a high-pressure mode is performed during starting in the oil pump control process in another form of the present disclosure.
Figure 5:
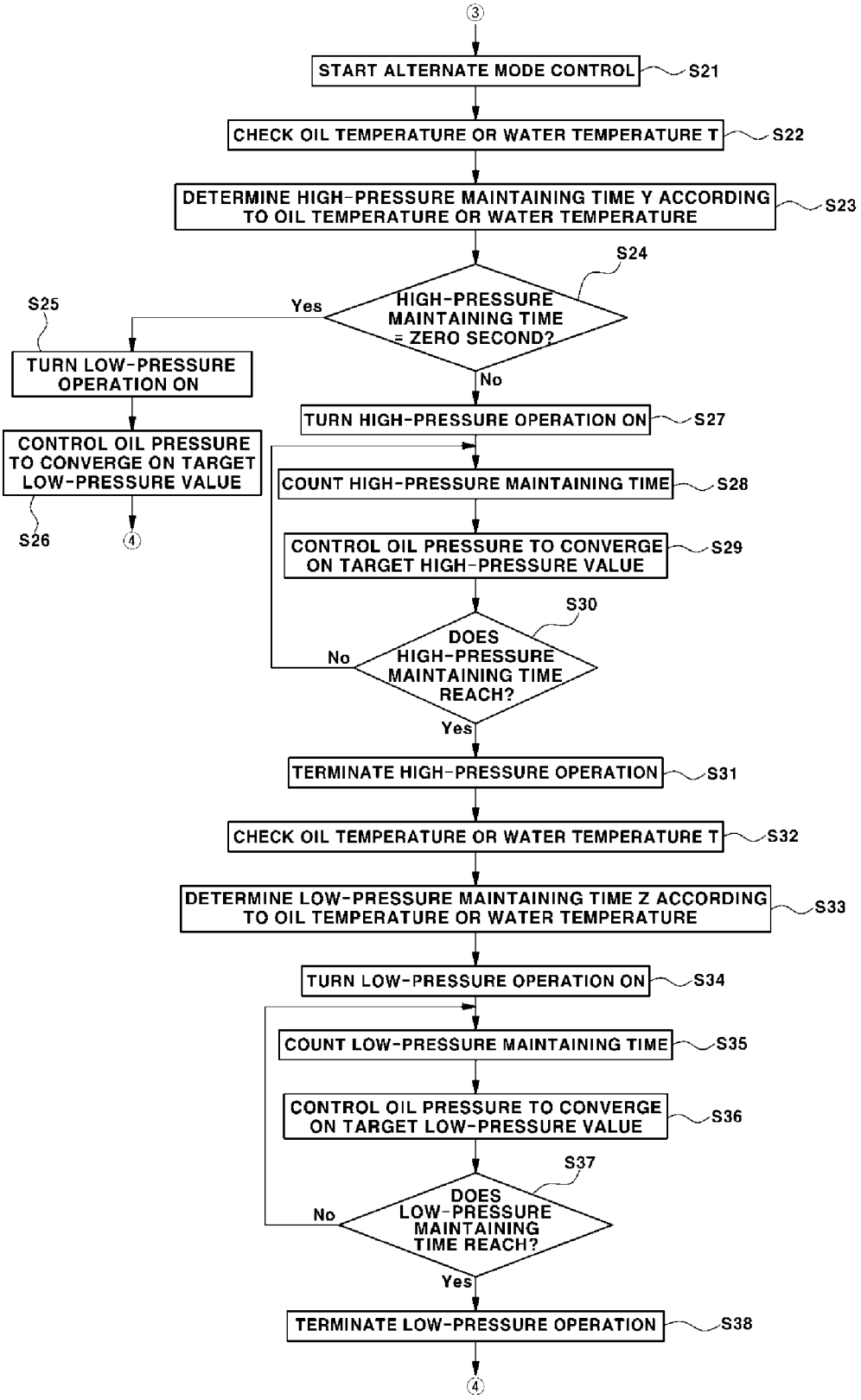
FIG. 5 is a flowchart illustrating a process in which an alternate mode is performed in the oil pump control process in one form of the present disclosure.

Further, FIG. 4 is a flowchart illustrating a process in which a high-pressure mode is performed during starting in the oil pump control process according to the present disclosure, and FIG. 5 is a flowchart illustrating a process in which the alternate mode is performed in the oil pump control process according to the present disclosure.

That is, the flowchart of FIG. 4 illustrates a detailed process of performing high-pressure mode control during starting of operation S5 of FIG. 3, and the flowchart of FIG. 5 illustrates a detailed process of performing alternate mode control of operation S7 of FIG. 3.

First, as shown in FIG. 3, when an engine starting request is detected in the vehicle (S1), the controller 20 acquires information on an engine operating state or a driving condition through the driving information detection part 10 (S2).

In this case, the controller 20 may detect the engine starting request from a signal of the starting switch 13 which is manipulated by a driver or detect the engine starting request from a signal of an engine management system (EMS) which is not shown.

Further, when the engine is started to be in an ON state after the engine starting request is detected, the controller 20 acquires real-time temperature information through the temperature sensor 11 of the driving information detection part 10 and acquires engine RPM information during starting through the engine through the engine RPM sensor 12.

As described above, the controller 20 acquires oil temperature information which is an oil temperature or water temperature information which is a cooling water temperature through the temperature sensor 11 as the real-time temperature information.

Then, the controller 20 determines whether a condition for each mode is satisfied on the basis of the acquired information (S4 and S6). After the engine start request is detected, the controller 20 determines whether the engine RPM detected through the engine RPM sensor 12 reaches a predetermined set RPM, and, when the detected engine RPM is determined as reaching the predetermined set RPM, the controller 20 determines whether a current oil temperature or a current oil water temperature, which is detected by the temperature sensor 11, satisfies a high-pressure mode condition during starting (S4).

In this case, when the current oil temperature or the current oil water temperature is less than or equal to the low critical temperature, the controller 20 determines that the high-pressure mode condition during starting is satisfied and then performs high-pressure mode control during starting shown in FIG. 4 (S5).

On the other hand, when the current oil temperature or the current water temperature exceeds the low critical temperature and is less than the high critical temperature during an engine operation, the controller 20 determines that an alternate mode condition is satisfied (S6) and performs alternate mode control shown in FIG. 5 (S7).

Further, when the current oil temperature or the current water temperature is greater than or equal to the high critical temperature, the controller 20 determines that a high-temperature and high-pressure mode condition is satisfied and performs high-temperature and high-pressure mode control (S8).

As described above, when any one among the high-pressure mode during starting, the alternate mode, and the high-temperature and high-pressure mode is performed, the controller 20 repeats the oil pump control process until an engine off request is detected. When the engine off request is detected during the oil pump control process (S9), the controller 20 terminates the oil pump control process at the same time as the engine is turned off.

On the other hand, when the controller 20 determines that the high-pressure mode condition during starting is satisfied to start the high-pressure mode control during starting (S11), the controller 20 checks the current oil temperature T or the current water temperature T again as shown in FIG. 4 (S12) and determines a high-pressure maintaining time X according to the current oil temperature or the current water temperature using the stored setting information (S13).

Then, the controller 20 turns the high-pressure operation on (S14), counts a time after the high-pressure operation is turned on (S15), and performs oil pressure control to converge the oil pressure on a predetermined target high-pressure value $P_{H_target_1}$ during the time counting (S16).

In this case, when the oil pressure is in a low state during the high-pressure maintaining time X, the controller 20 controls an operation of the oil pump system 30 to increase the oil pressure to reach the target high-pressure value $P_{H_target_1}$ and then controls the operation of the oil pump system 30 so as to allow the oil pressure to converge on the target high-pressure value $P_{H_target_1}$.

Subsequently, the controller 20 determines whether the counted time reaches the high-pressure maintaining time X (S17), and, when the counted time reaches the high-pressure maintaining time X, the controller 20 terminates the high-pressure operation control (S18).

Then, the control process proceeds to position ② in FIG. 3.

Next, in operation S4 of FIG. 3, when the controller 20 determines that the high-pressure mode condition during starting is not satisfied, the controller 20 checks whether the alternate mode condition, which is determined from the current oil temperature or the current water temperature, is satisfied (S6).

In this case, when the alternate mode condition is determined as being satisfied, the controller 20 starts the alternate mode control (operation S7 of FIG. 3 and operation S21 of FIG. 5).

When the alternate mode control is started (S21), the controller 20 checks the current oil temperature T or the current water temperature T again as shown in FIG. 5 (S22) and determines a high-pressure maintaining time Y according to the current oil temperature or the current water temperature using the stored setting information (S23).

Then, the controller 20 checks whether the high-pressure maintaining time Y is 0 sec. (S24), and, when the high-pressure maintaining time Y is 0 sec., the controller 20 turns the low-pressure operation on (S25). In this case, since the high-pressure operation is not necessary, only the low-pressure operation is performed by the controller 20 (S26).

That is, the controller 20 performs the oil pressure control to converge the oil pressure on a predetermined target low-pressure value $P_{L_target}$.

In this case, when the oil pressure is in a high state, the controller 20 controls the operation of the oil pump system 30 to lower the oil pressure to reach the target low-pressure value $P_{L_target}$ and then controls the operation of the oil pump system 30 so as to allow the oil pressure to converge on the target low-pressure value $P_{L_target}$ (S26).

As described above, the oil pump system 30 being controlled by the controller 20 to perform the low-pressure operation is that the high-pressure operation of the oil pump system 30 is not performed so that this is not the alternate mode in which the high-pressure operation and the low-pressure operation are alternately performed and this is a substantial termination of the alternate mode.

That is, operations S25 and S26 in FIG. 5 may be referred to as control operations in which the alternate mode is substantially terminated. A control operation during and after the oil pressure control converging on the target low-pressure value is performed in operation S26 may be referred to as position ④ in FIG. 3.

On the other hand, when the high-pressure maintaining time Y is determined as not being zero sec in operation S24, the controller 20 turns the high-pressure operation on first (S27), counts a time after the high-pressure operation is turned on (S28), and performs the oil pressure control to converge the oil pressure on the predetermined target high-pressure value $P_{H_target_2}$ (S29).

In this case, when the oil pressure is in a low state during the high-pressure maintaining time Y, the controller 20 controls the operation of the oil pump system 30 to increase the oil pressure to reach the target high-pressure value $P_{H_target_2}$ and then controls the operation of the oil pump system 30 so as to allow the oil pressure to converge on the target high-pressure value $P_{H_target_2}$.

Subsequently, the controller 20 determines whether the counted time reaches the high-pressure maintaining time Y (S30), and, when the counted time reaches the high-pressure maintaining time Y, the controller 20 terminates the high-pressure operation control (S31). Therefore, the high-pressure operation of the oil pump system 30 is terminated.

Then, the controller 20 checks the current oil temperature T or the current water temperature T again (S32) and determines a low-pressure maintaining time Z according to the current oil temperature or the current water temperature using the stored setting information (S33).

Then, the controller 20 turns the low-pressure operation on (S34), counts a time after the low-pressure operation is turned on (S35), and performs the oil pressure control to converge the oil pressure on the predetermined target high-pressure value $P_{L_target}$ (S36).

In this case, when the oil pressure is in a high state during the low-pressure maintaining time Z, the controller 20 controls the operation of the oil pump system 30 to lower the oil pressure to reach the target low-pressure value $P_{L_target}$ and then controls the operation of the oil pump system 30 so as to allow the oil pressure to converge on the target low-pressure value $P_{L_target}$.

Subsequently, the controller 20 determines whether the counted time reaches the low-pressure maintaining time Z (S37), and, when the counted time reaches the low-pressure maintaining time Z, the controller 20 terminates the low-pressure operation control (S38). Therefore, the low-pressure operation of the oil pump system 30 is terminated.

Then, the control process proceeds to position ④ in FIG. 3.

That is, the above-described high-pressure operation and the above-described low-pressure operation are set as one cycle, and, one cycle of the oil pressure control in which the high-pressure operation and the low-pressure operation are sequentially performed for the corresponding maintaining times is performed, the control process proceeds to position ④ in FIG. 3.

As described above, after position ④ in FIG. 3, when the high-pressure mode condition during starting is not satisfied in operation S4 of FIG. 3 and, simultaneously, the alternate mode condition is satisfied in operation S6 of FIG. 3, the alternate mode control shown in FIG. 5 is performed again (see operation S7 of FIG. 3 and FIG. 5).

In this case, after the controller 20 determines the high-pressure maintaining time Y according to the current oil temperature or the current water temperature, under the control of the controller 20, only the low-pressure operation in operations S25 and S26 is performed, or another one cycle of the high-pressure operation and the low-pressure operation is sequentially performed while the control process is performed from operation S27 to operation S38.

Consequently, after the high-pressure operation and the low-pressure operation are performed, the control process proceeds to position ④ of FIG. 3 again and then operations S4 and S6 are performed again so that the high-pressure operation and the low-pressure operation, which are shown in FIG. 5, may be alternately repeatedly performed. After that, the above-described control process may be continuously repeated until the engine off request is detected.

However, even though the operation of the alternate mode is performed until now, when the controller 20 determines that the high-pressure mode condition during starting is satisfied in operation S4, the controller 20 may switch to the high-pressure mode control during starting of operation S5, and the high-pressure mode control during starting of FIG. 4 may be performed.

Further, when the controller 20 determines that the alternate mode condition is not satisfied in operation S6, the high-temperature and high-pressure mode control is performed (S8). In this case, the controller 20 determines a high-pressure maintaining time corresponding to the current oil temperature or the current water temperature using the setting information and then controls the oil pressure to converge on the predetermined target high-pressure value during the determined high-pressure maintaining time.

That is, the controller 20 controls the operation of the oil pump system 30 to control the oil pressure to reach the target high-pressure value and controls the operation of the oil pump system 30 to allow the oil pressure to converge on the target high-pressure value during the high-pressure maintaining time.

Subsequently, when the counted time reaches the high-pressure maintaining time, the controller 20 terminates the high-temperature and high-pressure mode control and proceeds to operation S9 of FIG. 3.

In the alternate mode control in which the high-pressure operation and the low-pressure operation are alternately performed in the present disclosure, the low pressure means to include a low pressure as compared to a level of a basic control pressure of the oil pressure as well as a pressure equivalent to the level of the basic control pressure of the oil pressure, i.e., a general mapping pressure, in which an additional variation is not required, as compared to a basic control target.

In this way, the oil pump control method according to the present disclosure has been described in detail. As described above, when the current oil temperature or the current water temperature falls within a predetermined temperature range, alternate operation control of low and high pressures, i.e., the alternate mode control may be performed, In particular, owing to the high-pressure operation for a predetermined period of time, oil injection in the piston cooling jet may be performed.

Meanwhile, in order to improve an acceleration feeing and driving ability during rapid acceleration, an increase of responsiveness of a continuously variable valve timing (CVVT) operation is desired. In this case, when an opening speed of electronic throttle control (ETC) satisfies a rapid acceleration condition, the controller 20 may be set to perform control for the high-pressure operation (i.e., the high-pressure mode control).

In this case, the controller 20 is provided to receive a signal of an accelerator pedal position sensor (APS) 14, of the driving information detection part 10, for detecting an accelerator pedal operation state by a driver. When a current vehicle driving state is determined as satisfying a predetermined rapid acceleration condition from the signal of the APS 14, the controller 20 may be set to perform the high-pressure mode control that controls the operation of the oil pump system so as to converge the oil pressure on a predetermined target high-pressure value.

In this case, when an increase speed (rising slope) of an APS signal indicating an accelerator pedal manipulation depth (or a manipulated amount) is greater than or equal to a set value, the controller 20 may be set to determine that the rapid acceleration condition is satisfied. In order for the high-pressure operation, the controller 20 controls the operation of the oil pump system 30.

As described above, when the controller 20 determines that the rapid acceleration condition is satisfied, it is possible to improve the acceleration feeling by securing responsiveness of the CVVT through the high-pressure control of the oil pressure.

Further, as another form of the present disclosure, when the controller 20 determines that the vehicle is in a knocking generation condition (a high temperature/high load operation condition of the engine and the like), the controller 20 may be set to switch from the low-pressure operation to the high-pressure operation to perform control for the high-pressure operation.

To this end, the controller 20 may be provided to receive a knock signal through a network of the vehicle. When the controller 20 determines from the knock signal that a current engine operating condition or a current driving condition is the knocking generation condition of the engine, the controller 20 may be set to perform the high-pressure control that controls the operation of the oil pump system 30 so as to allow the oil pressure to reach a predetermined target high-pressure value.

Here, when the oil pressure reaches the target high-pressure value, the controller 20 may be set to terminate the high-pressure mode control. Alternatively, the controller 20 may be set to maintain the high-pressure mode control for a predetermined period of time after the high-pressure mode control is started and then terminate the high-pressure mode control.

Further, the knock signal may be an electrical signal which is output from a knock sensor.

Consequently, the oil injection through the cooling jet may be performed during the high-pressure operation, knocking generation may be prevented through the oil injection, noise generation due to engine knocking may be prevented, and it is possible to solve a problem of deterioration in driving ability such as a poor acceleration feeling due to ignition retarding.

In accordance with a method of controlling an oil pump of a vehicle, there is an effect which is capable of solving both a problem of poor lubrication of engine parts during low oil pressure control and a problem of degradation in fuel efficiency and poor exhaust gas emission during high oil pressure control.

Although the forms of the present disclosure have been described in detail, the scope of the prevent disclosure is not limited to these forms, and various modifications and improvements devised by those skilled in the art using the fundamental concept of the present disclosure.

What is claimed is:

1. A method of controlling an oil pump of a vehicle, the method comprising:

acquiring, by a controller, information on an engine operating state or a driving condition detected by a driving information detection part;

selecting, by the controller, a control mode satisfying a predetermined condition based on the acquired information on the engine operating state or the driving condition among a plurality of control modes for controlling an operation of an oil pump system; and controlling, by the controller, the operation of the oil pump system to control an oil pressure of an engine to a target value corresponding to the selected control mode among the plurality of control modes, wherein:

the plurality of control modes include an alternate mode;

when a predetermined condition of the alternate mode is satisfied, the alternate mode is selected; and in controlling the oil pump system, sequentially performing, by the controller, a high-pressure operation control that allows the oil pressure of the engine to converge on a predetermined target high-pressure value, and a low pressure operation control that allows the oil pressure of the engine to converge on a predetermined target low-pressure value.

2. The method of claim 1, wherein:

the plurality of control modes include a high-pressure mode;

when a predetermined condition of the high-pressure mode during starting the engine, the high-pressure mode is selected; and in controlling of operation of the oil pump system, performing, by the controller during starting the engine, a high-pressure mode control that allows the oil pressure of the engine to converge on the predetermined target high-pressure value.

3. The method of claim 2, wherein:

the driving information detection part includes: a temperature sensor configured to detect a temperature of an oil in the engine or a temperature of cooling water of the engine; and an engine revolutions per minute (RPM) sensor for detecting an engine RPM; and after an engine starting request is detected, when the engine RPM detected by the engine RPM sensor reaches a set RPM and the detected temperature of the oil or the cooling water of the engine is less than or equal to a predetermined low critical temperature, the controller determines that the predetermined condition of the high-pressure mode is satisfied.

4. The method of claim 3, wherein, when the detected temperature of the oil or the cooling water of the engine is greater than the predetermined low critical temperature and is less than a predetermined high critical temperature, the controller determines that a condition of an alternate mode is satisfied.

5. The method of claim 4, wherein, when the detected temperature of the oil or the cooling water is greater than or equal to the predetermined high critical temperature, the controller performs a high-temperature and high-pressure mode control that controls the oil pump system so as to allow the oil pressure of the engine to converge on a predetermined target high-pressure value.

6. The method of claim 3, wherein the high-pressure mode control during starting the engine includes:

determining a high-pressure maintaining time based on a current oil temperature or a current water temperature using information stored in the controller;

performing the high-pressure operation control that counts the high-pressure maintaining time after a high-pressure operation is turned on and allows the oil pressure of the engine to converge on the predetermined target high-pressure value while the high-pressure maintaining time is counted; and when a high-pressure maintaining time, during which the operation of the oil pump system is controlled, reaches the determined high-pressure maintaining time, terminating the high-pressure operation control.

7. The method of claim 1, wherein:

the driving information detection part includes: a temperature sensor configured to detect a temperature of engine oil or a temperature of cooling water of the engine; and when the detected temperature of the engine oil or the cooling water of the engine falls within a predetermined temperature range, the controller determines that the predetermined condition of the alternate mode is satisfied.

8. The method of claim 7, wherein an alternate mode control includes:

determining a high-pressure maintaining time based on a current oil temperature or a current water temperature using information stored in the controller;

performing the high-pressure operation control that counts the high-pressure maintaining time after a high-pressure operation is turned on and controls the oil pump system so as to allow the oil pressure of the engine to converge on the predetermined target high-pressure value while the high-pressure maintaining time is counted; and when the high-pressure maintaining time, during which the oil pump system is controlled, reaches a predetermined high-pressure maintaining time, terminating the high-pressure operation control and checking the current oil temperature or the current water temperature again;

determining a low-pressure maintaining time based on the current oil temperature or the current water temperature, which is checked again, using information stored in the controller;

performing a low-pressure operation control that counts the low-pressure maintaining time after a low-pressure operation is turned on and controls the oil pump system so as to allow the oil pressure of the engine to converge on the predetermined target low-pressure value while the low-pressure maintaining time is counted;

when the low-pressure maintaining time, during which the oil pump system is controlled, reaches a predetermined low-pressure maintaining time, terminating the low-pressure operation control; and when the predetermined condition of the alternate mode is satisfied until an engine off request is detected, repeating the alternate mode control.

9. The method of claim 8, further comprising:

after the determining of the high-pressure maintaining time, checking whether the high-pressure maintaining time is zero second; and when the high-pressure maintaining time is not zero second, repeating the alternate mode control.

10. The method of claim 9, wherein, when the high-pressure maintaining time is zero second, the controller turns on the low-pressure operation to count the low-pressure maintaining time and controls the oil pump system so as to allow the oil pressure of the engine to converge on the predetermined target low-pressure value while the low-pressure maintaining time is counted.

11. The method of claim 1, wherein:

the driving information detection part includes: an accelerator pedal position sensor configured to detect an accelerator pedal manipulation state by a driver;

the plurality of control modes include a high-pressure mode;

in selecting the control mode, when a predetermined rapid acceleration condition is satisfied based on a signal of the accelerator pedal position sensor, the controller selects the high-pressure mode; and when the high-pressure mode is selected, in controlling the oil pump system, the controller performs a high-pressure mode control that controls the oil pump system so as to allow the oil pressure of the engine to converge on the predetermined target high-pressure value.

12. The method of claim 1, wherein:

the plurality of control modes include a high-pressure mode;

in selecting the control mode, when the controller determines a knocking generation condition of the engine based on the engine operating state or the driving condition, the controller selects the high-pressure mode; and when the high-pressure mode is selected, in controlling the oil pump system, the controller performs a high-pressure mode control that controls the oil pump system so as to allow the oil pressure of the engine to reach the predetermined target high-pressure value.

* * * * *